US010858914B2

(12) United States Patent
Wu et al.

(10) Patent No.: US 10,858,914 B2
(45) Date of Patent: Dec. 8, 2020

(54) SILTY MARINE NATURAL GAS HYDRATE GRAVEL STIMULATION MINING METHOD AND MINING DEVICE

(71) Applicant: Qingdao Institute of Marine Geology, Qingdao (CN)

(72) Inventors: Nengyou Wu, Qingdao (CN); Yanlong Li, Qingdao (CN); Qiang Chen, Qingdao (CN); Changling Liu, Qingdao (CN); Jianye Sun, Qingdao (CN); Chengfeng Li, Qingdao (CN); Gaowei Hu, Qingdao (CN)

(73) Assignee: QINGDAO INSTITUTE OF MARINE GEOLOGY, Qingdao (CN)

( * ) Notice: Subject to any disclaimer, the term of this patent is extended or adjusted under 35 U.S.C. 154(b) by 0 days.

(21) Appl. No.: 16/321,045

(22) PCT Filed: Apr. 19, 2018

(86) PCT No.: PCT/CN2018/083712
§ 371 (c)(1),
(2) Date: Jan. 28, 2019

(87) PCT Pub. No.: WO2019/071933
PCT Pub. Date: Apr. 18, 2019

(65) Prior Publication Data

US 2019/0360314 A1 Nov. 28, 2019

(30) Foreign Application Priority Data

Oct. 11, 2017 (CN) ..... 2017 1 0940908

(51) Int. Cl.
*E21B 43/04* (2006.01)
*E21B 47/06* (2012.01)
(Continued)

(52) U.S. Cl.
CPC ..... *E21B 43/04* (2013.01); *E21B 41/0099* (2020.05); *E21B 47/06* (2013.01); *E21B 43/01* (2013.01)

(58) Field of Classification Search
CPC ..... E21B 43/04
See application file for complete search history.

(56) References Cited

U.S. PATENT DOCUMENTS

| | | | |
|---|---|---|---|
| 4,840,229 A | 6/1989 | Proctor et al. | |
| 6,581,689 B2 | 6/2003 | Hailey, Jr. | |
| 2014/0224486 A1* | 8/2014 | Traut | E21B 43/04 166/278 |

FOREIGN PATENT DOCUMENTS

| | | |
|---|---|---|
| CN | 102913205 A | 2/2013 |
| CN | 103867165 A | 6/2014 |

(Continued)

*Primary Examiner* — Robert E Fuller
(74) *Attorney, Agent, or Firm* — Bayramoglu Law Offices LLC

(57) ABSTRACT

The present invention discloses a silty marine natural gas hydrate gravel stimulation mining method and a mining device. The mining method appropriately relaxes the sand retention accuracy of a wellbore, so that the fine sand and muddy components of the stratum can flow into the wellbore, and after a certain period of production, the coarse gravels are injected into the extra-pipe stratum of the production well to fill the deficit caused by the production of the fine components of the stratum and the hydrates, and then the well is opened for production. The method achieves the triple objectives of improving the productivity of the silty reservoir, preventing the large-area deficit in the stratum and extending the effective period of the sand retention of the wellbore, by way of the alternation of the rounds of the gravel injection and the hydrate reservoir fluid extraction.

6 Claims, 3 Drawing Sheets

(51) Int. Cl.
*E21B 41/00* (2006.01)
*E21B 43/01* (2006.01)

(56) References Cited

FOREIGN PATENT DOCUMENTS

| | | | |
|---|---|---|---|
| CN | 105781499 | A | 7/2016 |
| CN | 107869331 | A | 4/2018 |

* cited by examiner

SILTY MARINE NATURAL GAS HYDRATE GRAVEL STIMULATION MINING METHOD AND MINING DEVICE

CROSS REFERENCE TO RELATED APPLICATIONS

This application is the national phase entry of International Application PCT/CN2018/083712, filed on Apr. 19, 2018 which is based upon and claims priority to Chinese Patent Application No. 201710940908.4, filed on Oct. 11, 2017 the entire contents of which are incorporated herein by reference.

TECHNICAL FIELD

The present invention belongs to the field of high-efficiency exploitation of marine natural gas hydrate, and more specifically, to a silty marine natural gas hydrate gravel stimulation exploitation device and an exploitation method.

BACKGROUND

Natural gas hydrates, an important potential energy source, are widely distributed in high-lying terrestrial permafrost and continental marginal sea sediments. How to safely and efficiently exploit them has become a hot research spot in the world. In recent years, all countries around the world have gradually shifted focus from the former hydrate basic research and hydrate resource exploration to the natural gas hydrate trial exploitation stage. Especially in countries where conventional oil and gas resources are scarce, such as Japan, a large number of seawater natural gas hydrate trial exploitation research has been carried out and the industrialization target of medium and long-term hydrate exploitation has been formulated. From the point of view of exploitation methods, the current natural gas hydrate exploitation methods are mainly divided into pressure-reducing exploitation method, hydrothermal exploitation method, $CO_2$ displacement exploitation method and chemical injection exploitation method. From the Mallik 5L-38 hydrate trial exploitation in 2002 to the South China Sea hydrate trial exploitation in 2017, the above exploitation methods have been verified by some or all of the field tests.

All trial exploitation practices have shown that the depressurization exploitation method is the most promising method of the natural gas hydrate exploitation. However, both China's first seawater natural gas hydrate trial exploitation and many times of hydrate trial exploitation made by foreign countries still stay in a scientific experimental stage, and there are still many key technologies to be solved from industrial exploitation. The depressurization method still faces key problems such as the instability of the stratum and the difficulty in long-term exploitation and production due to large-scale sand production in the process of exploitation natural gas hydrates in the sea area. Especially for the silty hydrate reservoirs distributed in large areas of China's seas, the fluid extraction method improved on the basis of the conventional anti-pressure method has achieved success in short-term trial exploitation (60 days). However, in view of the small particle size and the high clay content of this kind of reservoir sediments, it is a very weakly consolidated low-permeability or ultra-low-permeability reservoir. If the sand is strictly blocked in accordance with the conventional sand retention method for oil and gas reservoirs during the exploitation process, it is inevitable that the production capacity of the production well will be seriously impacted; on the contrary, if the accuracy of the sand retention in the wellbore is slightly amplified, the fine particles or muddy particles of the near-well stratum will easily flow into the wellbore, which will inevitably lead to the deficit of the near-well stratum. The deficit caused by the production of fine components of the stratum and the superposition of the deficit caused by the decomposition of hydrates will cause the reservoir to face serious stability problems. Therefore, in terms of the demand for the exploitation of silty reservoir hydrates by the depressurization method, further improvement and optimization of the depressurization method is required. In the depressurization exploitation process, it is necessary to inject other substances into the reservoir to solve the above problems.

The $CO_2$ displacement exploitation method provides an idea for maintaining the stability of natural gas hydrate reservoirs, but this method will form $CO_2$ hydrate during the replacement process, which reduces the permeability of the near-well stratum, thus leading to the difficulty of continuous exploitation in the later stage. This method is still facing serious exploitation efficiency problems in large-diameter silty reservoirs (IgnikSikumi-2012 trial exploitation in the United States). For silty reservoirs, the application effect can be imagined. Therefore, although the $CO_2$ replacement method can provide some reference for the long-term exploitation of hydrates, the replacement of hydrates by hydrates is obviously not available during the long-term exploitation of silty hydrates. If a hydrate can be found to be replaced by other high-permeability substances (while the near-well muddy or fine silt are replaced), it will have an impact on the long-term exploitation of hydrates will be impacted revolutionary.

If the above $CO_2$ is replaced by a hot steam injection, the $CO_2$ replacement method is a heat injection method in the usual sense. Although this method helps to maintain the stratum pressure and slow down the stratum instability to a certain extent, it cannot solve the stratum instability problem fundamentally, and it has been proved by the Mallik 2L-38 hydrate trial exploitation that the applicability is very limited to the exploitation of the marine natural gas hydrate.

In the development of conventional heavy oil reservoirs, steam stimulation is commonly used to achieve single well production improvement. At present, there is a very mature application, but for marine gas hydrate reservoirs, the efficiency of steam stimulation and the improvement of the stability of reservoirs are not optimistic. Therefore, in terms of actual demand, hydrate exploitation requires "stimulation", but the "stimulated" substance must not be steam but a substance that promotes the decomposition of hydrates and fills the stratum deficit.

In 2013, Japan's first marine natural gas hydrate trial exploitation project used the open-hole extra gravel filling sand retention technology, and achieved an output of 120,000 square meters of natural gas within 6 days, which greatly encourages the confidence of the global marine gas hydrate research. The extra-gravel filling layer plays a very good role in improving productivity and sand retention at the beginning of production. However, with the end of the trial exploitation, the sand retention completion technology is misunderstood to be not suitable for the marine natural gas hydrate exploitation, because in the hydrate stratum process, the extra-layer space is gradually enlarged and the gravel filling layer is creeping and deficient, thus causing the produced fluid to directly impact the screen. The impact quickly generates the erosion damage, thus causing a sharp decline (6d) in the effective period of sand retention, so that the hydrate trial exploitation is forced to terminate.

In summary, there are still the following key issues between the current natural gas hydrate exploitation method and the actual field needs:

1. the depressurization method cannot solve the problem of stratum deficit under long-term hydrate exploitation conditions, and the conventional sand retention operation faces the challenge of sand retention failure caused by stratum deficit;

2. long-term stable hydrate production urgently needs to fill or replace the stratum deficit in time, but the $CO_2$ replacement method can only solve the deficit caused by the hydrate output, but cannot solve the deficit caused by the stratum silt production; this method also has an impact on the further production of natural gas hydrates;

3. the steam stimulation method has a very wide application in the exploitation of conventional heavy oil reservoirs, but the "steam" produced by the steam stimulation method can only promote the decomposition of hydrates and cannot fill the stratum deficit;

4. although the one-time open-hole gravel filling sand retention completion operation can play a good role in a short period of time, but because there is no follow-up source supply, the effective period of sand retention is short, which is insufficient to meet the long-term exploitation demand of the marine gas hydrates.

Therefore, it is urgent to propose a new development method that can prevent Large hollows in the stratum, so as to cooperate with the commonly used anti-pressure method to fundamentally solve the engineering geological disasters, such as the serious sand production of the stratum and the instability of the stratum, encountered in the current seawater natural gas hydrate trial exploitation process, which is essential for prolonging the life cycle of the natural gas hydrates and also contributes to the effective advancement of the natural gas hydrate industrialization in China's sea areas.

SUMMARY

The technical problem to be solved by the present invention lies in the contradiction of the improvement of productivity, sand retention measures and stratum instability in the process of depressurization or fluid extraction of clay silty natural gas hydrates distributed in large areas in China, to provide a silty marine natural gas hydrate gravel stimulation exploitation device and an exploitation method based on the sand production management concept.

The present invention is achieved by the following technical solution: a silty marine natural gas hydrate gravel stimulation exploitation method, comprising the following steps of:

(1) drilling to the target horizon so as to perform an open-hole screen completion on the hydrate reservoir;

(2) installing and inserting the wellbore string combination;

(3) filling an area outside a mechanical screen with gravel, and stopping the filling in response to a change of a filling pressure:

(4) not taking out the original string combination, adjusting the valve flow and opening the well for a production, and observing the sand production situation in the stratum and the change in the pressure difference of the production at the bottom of a well in real time;

Step (3) and step (4) are switched and alternated in time according to the time node, so that the injected gravels continuously fill and replace the stratum deficit, so as to maintain the long-term production of the marine silty natural gas hydrate.

Further, Step (1) is achieved by opening a hydrate reservoir, sealing the overlying stratum of the hydrate reservoir by using a production casing, inserting the mechanical screen for the independent completion of a screen under the open eye for the hydrate reservoir, and lays an artificial well bottom; a gravel filling tool is mounted between the mechanical screen and the upper production casing.

Further, in Step (2), the installation method of the string combination is as follows: a gravel filling tool, a production oil pipe and a filling string are inserted, wherein the production oil pipe and the filling string are located in the production casing, and the filling string is respectively communicated with the production oil pipe and gravel filling tool; the gravel filling tool is located at the top of the hydrate reservoir, and a control valve and a gas separator are installed at the inlet end of the production oil pipe; and a one-way control valve is further provided at the connection between the gravel filling tool and the production oil pipe, and a filling switching valve is further provided on the gravel filling tool.

Further, in Step (3) gravel filling process, the one-way control valve on the lower side of the gravel filling tool is closed, the gravel filling switching valve is opened, the control valve at the lower end of the production oil pipe is closed, and the gravel is injected into the outside of the mechanical screen through a channel formed by the filling string and the gravel filling tool, to form a gravel filling layer. During the gravel injection process, the sand-carrying liquid passes through the mechanical screen and returns from the wellbore annulus to the platform wellhead, wherein the wellbore annulus is an annulus formed by the outer wall of the production oil pipe and the filling string as well as the inner wall which generates the casing; the pressure change of the pump outlet where the mortar is injected during a gravel injection process is observed: when the gravel injection pressure gradually increases from P0 to P1, the gravel injection is stopped and transferred to the next production stage, wherein P0 is the starting pressure of the gravel injection and P1 is the maximum pressure of the gravel injection.

Further, in the process of transferring Step (3) to Step (4): the one-way control valve on the lower side of the gravel filling tool is opened, the gravel filling switching valve is closed, the control valve at the lower end of the production oil pipe is opened, and a lifting pump is started to extract the stratum fluids and start the depressurization production;

In the process of Step (4), the gas-liquid-solid three-phase produced from the hydrate reservoir flows into the wellbore, and after a separation by the gas separator, the liquid-solid two-phase flows through the production oil pipe to the wellhead, so that the gas is produced through the wellbore annulus;

During the implementation of Step (4), the sand concentration parameter of the wellhead and the flow pressure change at the bottom of the well are monitored in real time; in case of a sudden increase in the sand concentration or a sudden increase in the pressure difference at the bottom of the well, the further step of the depressurization production is stopped and transferred to Step (3).

Further, the process of Step (4) comprises the process of continuously injecting water or a liquid containing a hydrate inhibitor into the inside of the production oil pipe by filling the string to ensure that the fine sand produced from the stratum can be carried to the wellhead at the same time while the secondary generation of the hydrate can be prevented.

Further, the time node of transferring Step (4) hydrate depressurization production process to Step (3) gravel injection is judged according to the abnormality of sand production in the wellbore, or the sudden change of the production pressure difference at the bottom of the well without a manual pressure regulation; the time node of transferring Step (3) gravel injection to Step (4) hydrate depressurization production is that the gravel injection pressure rapidly increases and the gravel cannot be continuously injected, wherein the judgment of abnormality of the sand production from a wellbore is based on the fluctuation of the pressure at the bottom of the well under steady production conditions, the rise of the sanding temperature of the lifting pump and the increase of the sand concentration at the wellhead to be observed.

Further, the particle size of the gravel used in the filling in Step (3) is larger than Level 1-Level 2 of the result designed by the Saucier method in the same exploitation environment.

Further, the particle size of the gravel used in the filling in Step (3) is larger than Level 1-Level 2 of the result designed by the Saucier method in the same exploitation environment; the sand retaining accuracy of the mechanical screen in Step (1) is greater than the accuracy of Level 2-Level 3 of the mechanical screen used by the conventional open hole gravel filling in the oil and gas well under the same stratum conditions.

The present invention further provides a silty marine natural gas hydrate gravel stimulation production device, comprising a production casing, a production oil pipe and a filling string provided in the production casing, and a lifting string provided in the production oil pipe, wherein the lifting string is connected with the lifting pump, and a gap formed between the outer wall of the production oil pipe and the filling pipe string and the inner wall of the production casing is a wellbore annulus;

the lower end of the production casing is connected with a mechanical screen, and a gravel filling tool is further provided between the production casing and the mechanical screen; the production casing is inserted into the upper position of the hydrate reservoir, and the gravel filling tool is located at the top of the hydrate reservoir while the mechanical screen is located at the lower hydrate reservoir, so that the gravel filling tool can depressurize the wellbore without being taken out, and a gas separator and a control valve are further provided at the lower end of the production oil pipe;

the outlet end of the filling string is respectively connected with the gravel filling tool and the production oil pipe, an one-way control valve is provided at the communication point between the gravel filling tool and the production oil pipe, a filling switching valve is further provided on the gravel filling tool, and the filling string is the bottom of the gravel filling tool is communicated with the production oil pipe; when the gravel is injected into the filling string, the mixed mortar is separately filled into the extra-pipe stratum of the production casing, and in the production stage, the production oil pipe can be replenished for the sand carrying in the wellbore.

Compared with the prior art, the advantages and positive effects of the present invention are as follows:

(1) the solution of the present invention replaces a solid phase (mud, silty fine particles and hydrate) by the solid phase (large-diameter gravel) stimulation, and appropriately relaxes the sand retention accuracy of a mechanical screen and selects a suitable gravel to assists a timely discharge of the muddy or fine particles in the near-well stratum during a hydrate decomposition process so as to prevent a blockage of the wellbore, thus effectively overcoming the shortcomings such as the high muddy content and the low permeability of the marine silty hydrate reservoir, and the cementation and unblocking which are not suitable for fracturing transformation, and effectively improving the pressure transmission efficiency of the wellbore and the near-well stratum, which escorts the hydrate depressurization/production improvement of the fluid extraction production wells;

(2) the present invention can intermittently stop the depressurization/fluid extraction production and extrude the gravel into the extra-pipe stratum, and can timely replenish the stratum deficit, thus effectively extending the effective period of sand retention and the depressurization exploitation cycle, effectively solving the stratum deficit and stratum instability caused by a long-term hydrate exploitation, prolonging the depressurization/fluid extraction and exploitation cycle, and providing a basis for the industrial exploitation of hydrates;

(3) the present scheme is suitable for the high mud and silty marine natural gas hydrate reservoirs which are not suitable for a complete sand retention and reservoir transformation, suitable for the pore-filled reservoir or the natural gas hydrate reservoir with thin massive hydrate interlayers; it solves the problem of the low efficiency of the marine natural gas hydrate $CO_2$ displacement exploitation, the difficulty in maintaining the reservoir stability by way of heat injection exploitation, and the short-term effective period of previous extra-pipe gravel filling sand retention operation, and solves the difficulty in the improvement of the natural gas hydrate production capacity and the large risk the instability of the reservoir in China's seas, so as to promote the development of the commercial hydrate exploitation technology.

wherein: 1—production casing; 2—production oil pipe; 3—filling oil string; 4—gravel filling tool; 5—one-way control valve; 6—mechanical screen; 7—gravel filling layer; 8—hydrate reservoir stratum; 9—overlying stratum of the hydrate reservoir; 10—gas separator; 11—control valve; 12—gravel filling switching valve; 13—wellbore annulus; P0—starting pressure of the gravel injection; P1—maximum pressure of the gravel injection.

DETAILED DESCRIPTION OF THE EMBODIMENTS

The above described objects, features and advantages of the present invention will be more fully understood from the further description in combination with the following drawings and embodiments. It shall be noted that the embodiments in the present application and the features in the embodiments may be combined with each other without a conflict.

Figure 1:
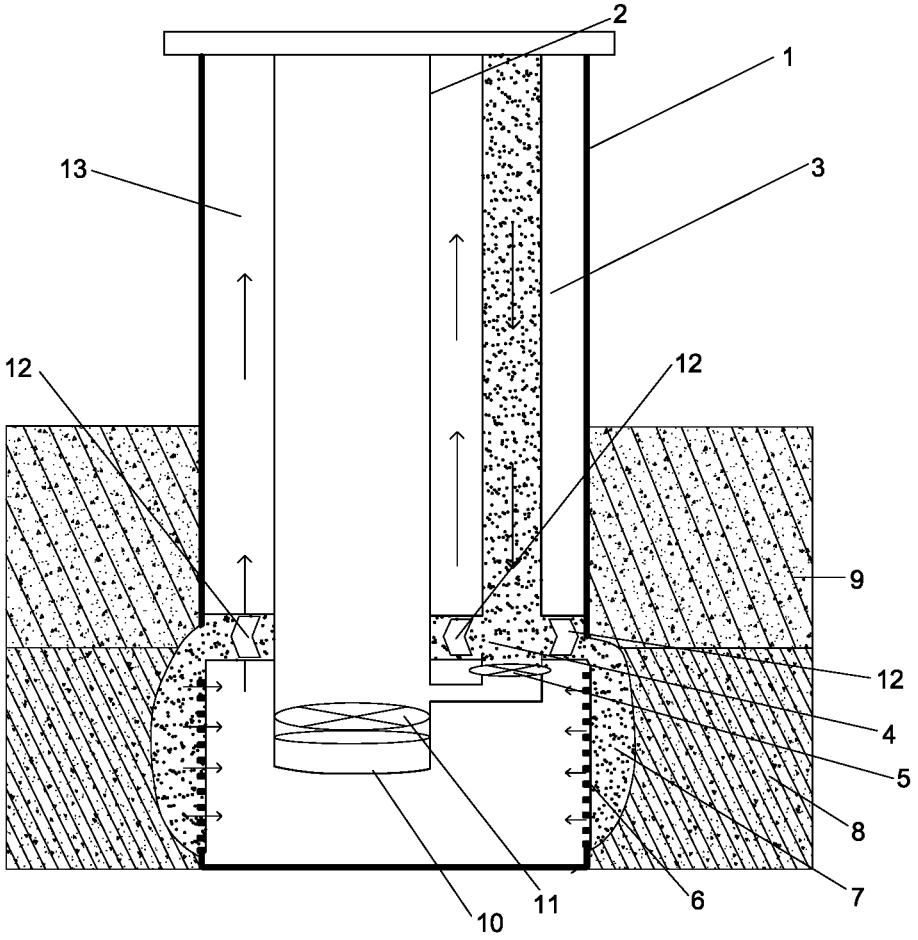
FIG. 1 is a schematic view showing the gravel injection by way of a gravel stimulation exploitation device in an embodiment of the present invention.
Figure 2:
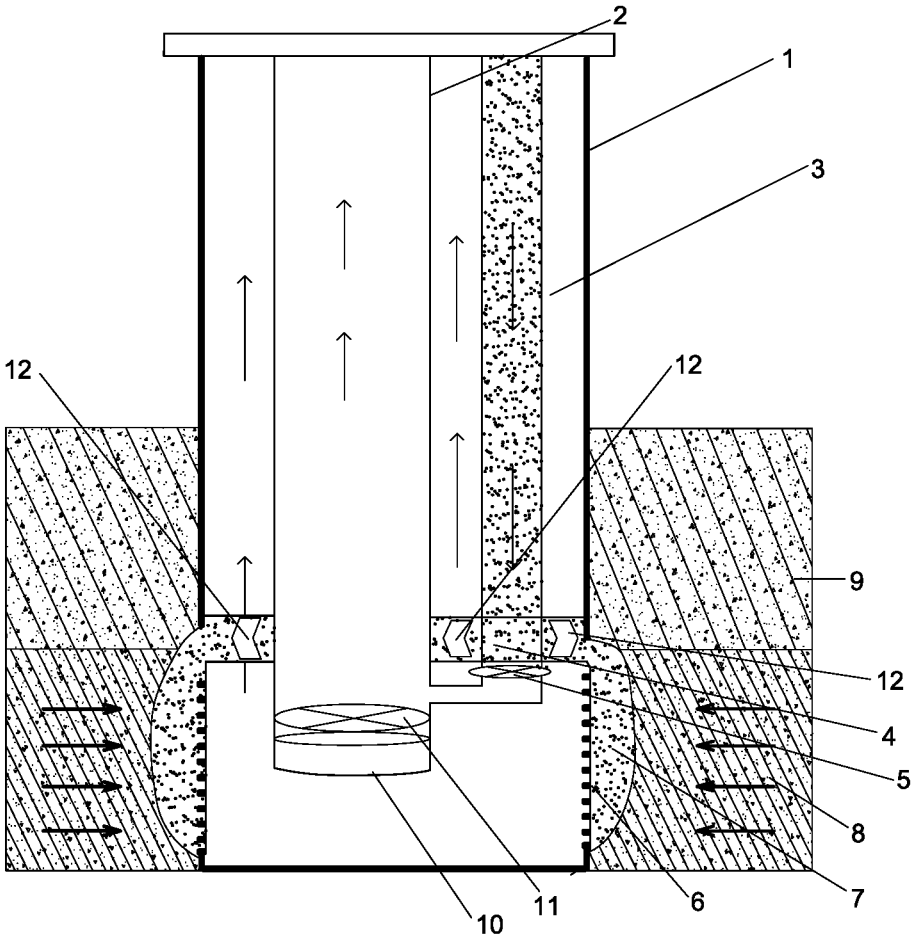
FIG. 2 is a schematic view showing the stratum output by way of the gravel stimulation exploitation device in an embodiment of the present invention.

The present invention proposes a new idea of the silty marine natural gas hydrate gravel stimulation exploitation, by way of injecting a certain size of gravel into the exploitation stratum to achieve the "swallowing" of the gravel by the stratum so as to continuously fill the stratum deficit space caused by the hydrate decomposition and the stratum muddy output; applying the natural gas hydrate sand production management technology, and appropriately widening the slit width of the mechanical screen and the particle size of the swallowed gravel, so as to make the muddy and fine particles in the near-well stratum discharged from the stratum in accordance with a certain proportion, to realize the "spitting" of the fine components of the stratum; through the exchange of the above substances, the stimulation of the fine components of the stratum and the coarse gravel can be replaced, thus effectively filling the stratum deficit and preventing the instability of the stratum while improving the permeability of the near well and promoting the effective decomposition of the hydrate, which provides a new idea for the exploitation of silty hydrates in China's seas; the idea is specifically achieved through the following schemes:

Embodiment 1: a silty marine natural gas hydrate gravel stimulation exploitation method, referring to the structural principle described in FIG. 1 and FIG. 2, comprising the following steps:

(1) drilling to the target horizon so as to perform a open-hole screen completion on the hydrate reservoir;

(2) installing and inserting the wellbore string combination;

(3) filling an area outside a mechanical screen with gravel, and stopping the filling in response to a change of a filling pressure;

(4) not taking out the original string combination, adjusting the valve flow and opening the well for a production, and observing the sand production situation in the stratum and the change in the pressure difference of the production at the bottom of a well in real time;

Step (3) and step (4) are switched and alternated in time according to the time node, so that the injected gravels continuously fill and replace the stratum deficit, so as to maintain the long-term production of the marine silty natural gas hydrate.

Figure 3:
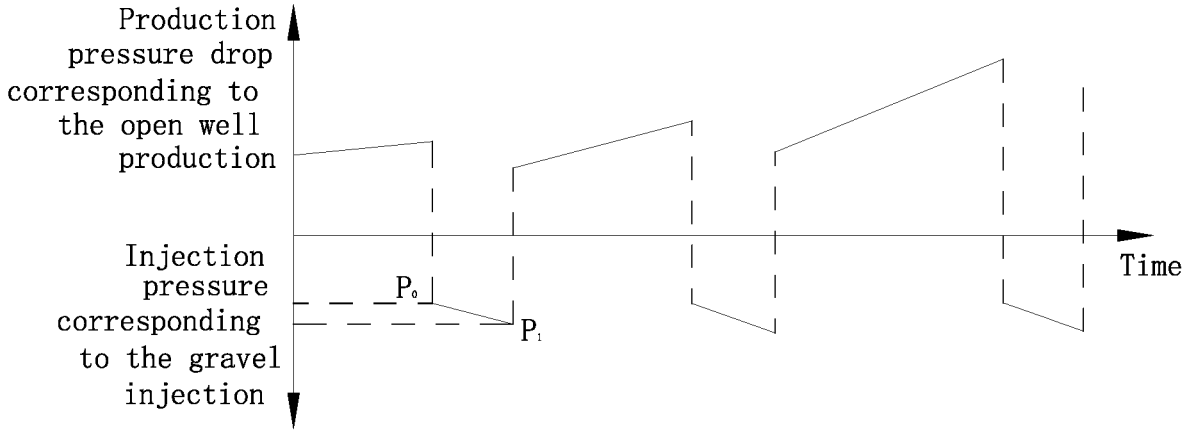
FIG. 3 is a schematic view showing the progress of a gravel stimulation exploitation cycle in an embodiment of the present invention.

Specifically, in Step (1), the conventional drilling operation of the shallow marine stratum is achieved by opening a hydrate reservoir 8, sealing the overlying stratum 9 of the hydrate reservoir by using a production casing 1, inserting the mechanical screen 6 for the independent completion of a screen under the open eye for the hydrate reservoir 8, and lays an artificial well bottom; a gravel filling tool 4 is mounted between the mechanical screen 6 and the upper production casing 1. In Step (2), the installation method of the string combination is as follows: a gravel filling tool 4, a production oil pipe 2 and a filling string 3 are inserted, wherein the production oil pipe 2 and the filling string 3 are located in the production casing 1, and the filling string 3 is respectively communicated with the production oil pipe 2 and gravel filling tool 4; the gravel filling tool 4 is located at the top of the hydrate reservoir 8, and a control valve 11 and a gas separator 10 are installed at the inlet end of the production oil pipe 2; and an one-way control valve 5 is further provided at the connection between the gravel filling tool 4 and the production oil pipe 2, and a filling switching valve 12 is further provided on the gravel filling tool 4.

in Step (3) gravel filling process, the one-way control valve 5 on the lower side of the gravel filling tool 4 is closed, the gravel filling switching valve 12 is opened, the control valve 11 at the lower end of the production oil pipe 2 is closed, and the gravel is injected into the outside of the mechanical screen 6 by way of the gravel filling tool 4 left at the bottom of the well through a channel formed by the filling string 3 and the gravel filling tool 4, to form a gravel filling layer 7. During the gravel injection process, the sand-carrying liquid passes through the mechanical screen 6 and returns from the wellbore annulus 13 to the platform wellhead, wherein the wellbore annulus is an annulus formed by the outer wall of the production oil pipe and the filling string as well as the inner wall which generates the casing, the change of the injection pressure during a gravel injection process is observed, as shown in the schematic view of a gravel stimulation cycle in FIG. 3: when the gravel injection pressure gradually increases from P0 to P1, the gravel injection is stopped, that is, when the pressure is observed to significantly increase, the process will be transferred to the next production stage, wherein P0 is the starting pressure of the gravel injection and P1 is the maximum pressure of the gravel injection; the maximum pressure P1 of the gravel injection is determined according to the pressure gradient of the stratum fracture, so that in order to ensure that no stratum fractures or pressure on the seabed mud surface in production, it is necessary to ensure that P1 is less than or equal to the stratum fracture pressure or the overburden pressure on the seabed.

in the process of transferring Step (3) to Step (4): the one-way control valve 5 on the lower side of the gravel filling tool 4 is opened, the gravel filling switching valve 12 is closed, the control valve 11 at the lower end of the production oil pipe 2 is opened, and a lifting pump is started to extract the stratum fluids, start the depressurization production and control the flow pressure at the bottom of the well; the natural gas hydrate depressurization method or the fluid extraction method shall be carried out under the condition of a lower production pressure difference, and the production pressure difference shall be slowly increased according to the actual conditions; in the process of Step (4), the gas-liquid-solid three-phase produced from the hydrate reservoir 8 flows into the wellbore, and after a separation by the gas separator 10, the liquid-solid two-phase flows through the production oil pipe 2 to the wellhead, so that the gas is produced through the wellbore annulus 13; during the implementation of Step (4), the sand concentration parameter of the wellhead and the flow pressure change at the bottom of the well are monitored in real time; in case of an abnormality occurring at the head or the bottom of the well, that is, a sudden increase in the sand concentration or a sudden increase in the pressure difference at the bottom of the well, the further step of the depressurization production is immediately stopped and transferred to Step (3), and the injected gravels continuously fill and replace the stratum deficit, so as to maintain the long-term production of the marine silty natural gas hydrate through a reciprocating cycle.

In order to achieve the triple objectives of improving the productivity of the silty reservoir, preventing the Large hollow in the stratum and extending the effective period of the sand retention of the wellbore, in the present embodiment, the position of the gravel filling tool 4 at the bottom of the well is at the top of the hydrate reservoir section 8; the process of Step (4) comprises the process of continuously injecting water or a liquid containing a hydrate inhibitor into the inside of the production oil pipe by filling the string to ensure that the fine sand produced from the stratum can be carried to the wellhead at the same time while the secondary generation of the hydrate can be prevented; in actual case, when the gravel is injected into the filling string 3, the mixed mortar is separately filled into the extra-pipe stratum, and in the production stage, the production oil pipe 2 can be replenished for the sand carrying in the wellbore.

Further, the time node of transferring Step (4) hydrate depressurization production process to Step (3) gravel injection is judged according to the abnormality of sand production in the wellbore, or the sudden change of the production pressure difference at the bottom of the well without a manual pressure regulation; the time node of transferring Step (3) gravel injection to Step (4) hydrate depressurization production is that the gravel injection pressure rapidly increases and the gravel cannot be continuously injected, wherein the judgment of abnormality of the sand production from a wellbore is based on the fluctuation of the pressure at the bottom of the well under steady production conditions, the rise of the sanding temperature of the lifting pump and the increase of the sand concentration at the wellhead to be monitored; the specific production process is determined according to the choice of the actual lifting system.

More importantly, the particle size of the gravel used in the filling in Step (3) is larger than Level 1-Level 2 of the result designed by the Saucier method in the same exploitation environment; the sand retaining accuracy of the mechanical screen in Step (1) is greater than the accuracy of Level 2-Level 3 of the mechanical screen used by the conventional open hole gravel filling in the oil and gas well under the same stratum conditions, which assists a timely discharge of the muddy or fine particles in the near-well stratum during a hydrate decomposition process so as to prevent a blockage of the wellbore, so that the pressure transmission efficiency of the hydrate wellbore and the decomposition efficiency of the hydrate are improved, and the size of the gravel used in the gravel injection process is consistent with the size of the gravel used in the completion of the open hole filling.

Due to the continuous decomposition of stratum hydrates and the production of some muddy and fine particles in the long-term exploitation process of hydrates, the stratum will always suffer a certain degree of deficit, and the pre-filled gravel will suffer a certain degree of creep, people shall intermittently stop the depressurization/fluid extraction production and squeeze the gravel into the extra-pipe stratum, to effectively fill this part of the deficit and prevent the large area of the stratum from being deficient; if the stratum is not replenished in time, the pre-filled gravel will creep and sink, causing the sand retention screen at the bottom of the well to directly face the frontal erosion of the fluid produced from the stratum, which will reduce the effective period of the sand retention operation; based on the plan to timely replenish the stratum deficit, the effective period of sand retention will be effectively extended.

After multiple rounds of the hydrate depressurization/fluid extraction and exploitation as well as the gravel extrusion process, a material exchange between the near-well muddy and fine gravel and large-size gravel is realized, which significantly reduces the additional pressure drop in the near well so as to generate a synergistic effect with the sand particle size design and the sand screen accuracy design of mechanical screen, jointly promoting the further decomposition of hydrate and improving the productivity of the silty hydrate reservoir; moreover, the selection of the open-hole filling sand retention completion operation facilitates a smooth mortar flow channel in the later stage when the gravel is injected to the outside of the pipe, so as to ensure that the mortar is intermittently squeezed into the extra-pipe stratum; the gravel filling tool is placed at the top of the hydrate reservoir because the pre-injected gravel stratum will creep and sink during the hydrate production process, and the stratum deficit space is mainly in the upper part of the hydrate reservoir. Therefore, this design helps to intermittently inject the gravel in the later stage to ensure a smooth progress of the gravel stimulation process;

the filling string is also used as a wellbore replenishing string in the post-gravel stimulation string and hydrate depressurization/fluid extraction and exploitation process; a three-way design realizes the switching of the wellbore hydration and mortar injection, thus simplifying the design of the wellbore string. At the same time, part of the muddy and fine components which are produced into the wellbore during the hydrate depressurization/fluid extraction process can be smoothly carried to the wellhead with the help of the water supply line to prevent the wellbore from blocking. At the same time, the pipeline can also be used as a hydrate inhibitor injection pipeline to ensure the safe flow of the wellbore and ensure the continuous advancement of the gravel stimulation process.

Embodiment 2: the present embodiment further provides a silty marine natural gas hydrate gravel stimulation production device, as shown in FIG. 1 and FIG. 2, comprising a production casing 1, a production oil pipe 2 and a filling string 3 provided in the production casing 1, and a lifting string provided in the production oil pipe 2 (not shown), wherein the lifting string is connected with the lifting pump, and a gap formed between the outer wall of the production oil pipe 2 and the filling pipe string 3 and the inner wall of the production casing 1 is a wellbore annulus 13; the lower end of the production casing 1 is connected with a mechanical screen 6, and a gravel filling tool 4 is further provided between the production casing 1 and the mechanical screen 6; the production casing 1 is inserted into the upper position of the hydrate reservoir 8, and the gravel filling tool 4 is located at the top of the hydrate reservoir 8 while the mechanical screen 6 is located at the lower hydrate reservoir, so that the gravel filling tool 4 can depressurize the wellbore without being taken out, and a gas separator 10 and a control valve 11 are further provided at the lower end of the production oil pipe.

The outlet end of the filling string 3 is respectively connected with the gravel filling tool 4 and the production oil pipe 2, an one-way control valve 5 is provided at the communication point between the gravel filling tool 4 and the production oil pipe 2, a filling switching valve 12 is further provided on the gravel filling tool 4, and the filling string 3 is the bottom of the gravel filling tool 4 is communicated with the production oil pipe 2; when the gravel is injected into the filling string 3, the mixed mortar is separately filled into the extra-pipe stratum of the production casing 2, and in the production stage, the production oil pipe can be replenished for the sand carrying in the wellbore.

Through the design of the above-mentioned exploitation device, the fine particles and the muddy gravel of the stratum are allowed to be produced into the wellbore during a hydrate exploitation process, and are carried to the wellhead by way of an effective wellbore hydration of the filling string; the gravels with a large particle size are used to fill the deficit caused by the production of the fine particles and muddy gravels, which achieves the triple objectives of improving the productivity of the silty reservoir, preventing the Large hollow in the stratum and extending the effective period of the sand retention of the wellbore, thus providing a new idea for the exploitation of silty hydrates in China's seas and promoting the development of the commercial hydrate exploitation technology.

The above description is only a preferred embodiment of the present invention, and is not intended to limit the scope of the present invention. Any person skilled in the art may use the above-disclosed technical contents to change or modify the equivalent changes. The equivalent embodiment is applied to other fields, but any simple modification, equivalent change and modification made to the above embodiments according to the technical essence of the present invention are still included in the protection scope of the technical solution of the present invention without departing from the technical solution of the present invention.

What is claimed is:

1. A silty marine natural gas hydrate gravel stimulation exploitation method, comprising:

(1) drilling a wellbore to a target horizon to perform an open-hole screen completion on a hydrate reservoir;

(2) installing a wellbore string combination in the wellbore;

(3) filling an area outside a mechanical screen with gravel, and stopping the filling in response to a change of a filling pressure;

(4) adjusting a valve for initiating a production, and monitoring a sand concentration parameter at a wellhead and a flow pressure of a production fluid at a bottom of the wellbore in real time while the wellbore string combination remains in the wellbore;

wherein step (3) and step (4) are repeated, so that the gravel continuously fills and replaces a deficit of strata, so as to maintain a long-term production of a marine silty natural gas hydrate.

2. The silty marine natural gas hydrate gravel stimulation exploitation method of claim 1, wherein the open-hole screen completion in step (1) is achieved by opening the hydrate reservoir, sealing an overlying stratum of the hydrate reservoir by using a production casing, inserting the mechanical screen, and laying an artificial, well bottom; and a gravel filling tool is mounted between the mechanical screen and the production casing located above the mechanical screen.

3. The silty marine natural gas hydrate gravel stimulation exploitation method of claim 1, wherein in step (2), a method of installing the wellbore string combination comprises: inserting a gravel filling tool, a production oil pipe and a filling string, wherein the production oil pipe and the filling string are located in a production casing, and the filling string is respectively communicated with the production oil pipe and the gravel filling tool; the gravel filling tool is located at a top of the hydrate reservoir, and a control valve and a gas separator are installed at an inlet end of the production oil pipe; and a one-way control valve is further provided at a connection between the gravel filling tool and the production oil pipe, and a filling switching valve is further provided on the gravel filling tool.

4. The silty marine natural gas hydrate gravel stimulation exploitation method of claim 1, wherein step (3) further comprises: opening a one-way control valve on a lower side of a gravel filling tool, closing a gravel filling switching valve, opening a control valve at a lower end of a production oil pipe, and starting a lifting pump to extract stratum fluids and starting the production;

step (4) further comprises: enabling three phases of gas, liquid, and solid produced from the hydrate reservoir to flow into the wellbore, and after a separation by a gas separator, enabling two phases of liquid and solid to flow through the production oil pipe to the wellhead, so that gas is produced through a wellbore space;

wherein the sand concentration parameter of the wellhead and the flow pressure at the bottom of the wellbore are monitored in real time; in case of a sudden increase in the sand concentration parameter or a sudden increase in the flow pressure at the bottom of the wellbore, the production is stopped and returned to step (3).

5. The silty marine natural gas hydrate gravel stimulation exploitation method of claim 4, wherein step (4) comprises a process of continuously injecting water or a liquid containing a hydrate inhibitor into an inside of the production oil pipe by a filling string.

6. The silty marine natural gas hydrate gravel stimulation exploitation method of claim 1, wherein step (4) further comprises stopping the production when the production at the wellbore rises beyond a threshold value; step (3) further comprises stopping the filling when the filling pressure increases and the gravel fails to be continuously injected, wherein a judgment of the production from the wellbore rising beyond the threshold value is based on a change of the flow pressure at the bottom of the wellbore under production conditions, a temperature of a lifting pump and an increase of the sand concentration parameter at the wellhead to be monitored.

* * * * *